US006475587B1

(12) United States Patent
O'Neill

(10) Patent No.: US 6,475,587 B1
(45) Date of Patent: Nov. 5, 2002

(54) SELF-ADHESIVE DECORATIVE DEVICES

(75) Inventor: Daryl Philip O'Neill, Mitcham (AU)

(73) Assignee: Gone Fishing Flies PTY, Boronia Victoria (AU)

( * ) Notice: Subject to any disclaimer, the term of this patent is extended or adjusted under 35 U.S.C. 154(b) by 0 days.

(21) Appl. No.: 09/581,201

(22) PCT Filed: Jul. 1, 1998

(86) PCT No.: PCT/AU98/00504

§ 371 (c)(1),
(2), (4) Date: Jun. 19, 2000

(87) PCT Pub. No.: WO00/01541

PCT Pub. Date: Jan. 13, 2000

(51) Int. Cl.[7] ..... B44F 7/00

(52) U.S. Cl. ..... 428/40.1; 428/12; 428/15; 428/41.8; 428/42.1; 428/42.2; 428/42.3; 428/43; 428/201; 428/202; 428/203

(58) Field of Search ..... 428/40.1, 15, 12, 428/41.8, 42.1, 42.2, 42.3, 43, 201, 202, 203

(56) References Cited

U.S. PATENT DOCUMENTS 4,505,770 A 3/1985 Larimore ..... 156/235
5,021,575 A 6/1991 Kim ..... 428/42.1
5,585,888 A * 12/1996 Volkert ..... 428/40.1

FOREIGN PATENT DOCUMENTS

JP 9-300898 11/1997
NL 8000910 9/1981

* cited by examiner

*Primary Examiner*—Nasser Ahmad
(74) *Attorney, Agent, or Firm*—Dennison, Schultz & Dougherty

(57) ABSTRACT

A decorative device includes a supporting release layer, a flexible backing layer, an adhesive layer on the backing layer, the adhesive layer being covered by the release layer such that the backing layer is removable from the release layer to expose the adhesive layer on the backing layer, and a decorative layer disposed on a surface of the flexible backing layer opposite to the adhesive layer. A decorative article is printed on the decorative layer, the decorative article having a pair of wings, with a cut extending peripherally about the decorative article and penetrating through the decorative layer and the flexible backing layer, but not through the supporting release layer, the cut defining a decorative element which includes the wings. A strip of adhesive located between the wings adheres the decorative layer to the flexible backing layer, and enables the wings to be folded to stand out from the backing layer.

5 Claims, 1 Drawing Sheet

SELF-ADHESIVE DECORATIVE DEVICES

FIELD OF THE INVENTION

This invention relates to self-adhesive decorative devices.

BACKGROUND OF THE INVENTION

Self-adhesive decorative devices are widely available as decorations for flat surfaces such as book covers, domestic walls and doors, or any other surface requiring decoration. Known self-adhesive decorative devices usually suffer from the disadvantage that the decorated surface is substantially flat so that the decorative device is not able to stand out significantly from the surface being decorated.

SUMMARY OF THE INVENTION

It is an object of the present invention to provide a self-adhesive decorative device in which the outer surface of the device can be made to stand out from the surface being decorated.

The invention provides a decorative device including a self-adhesive flexible film backing member adapted to be adhered to a surface to be decorated, a semi-rigid plastics layer secured to said backing member so as to leave part of said semi-rigid plastics layer free to be folded with respect to the backing member, whereby said semi-rigid plastics layer can be made to stand out from the surface being decorated.

The semi-rigid plastics layer preferably has a plastics memory to enable substantially permanent folding of the plastics layer with respect to the backing member.

The backing member and semi-rigid plastics layer may be die cut with any desired shape or outline from larger sheets of flexible film and semi-rigid plastics material, and the semi-rigid plastics layer preferably carries printed decorative material to further enhance the decorative device.

The self-adhesive flexible film backing member is preferably carried by a supporting release layer to protect the adhesive against inadvertent adhesion. In most cases, a multiplicity of decorative devices will be carried by the supporting release layer with each decorative device die cut from larger sheets of flexible film backing material and semi-rigid plastics material.

The backing member is preferably formed from transparent or translucent plastics material so that it is less visible than the decorative device formed from the semi-rigid plastics layer.

In one form of the invention, the semi-rigid plastics layer carries printed replicas of butterflies, birds, aircraft, or other devices having wings, and each printed device is die cut around the periphery of the device through the semi-rigid plastics layer and through the flexible film backing member.

BRIEF DESCRIPTION OF THE DRAWINGS

An embodiment of the invention will now be described with reference to the accompanying drawings in which.

DESCRIPTION OF PREFERRED EMBODIMENT

Figure 1:
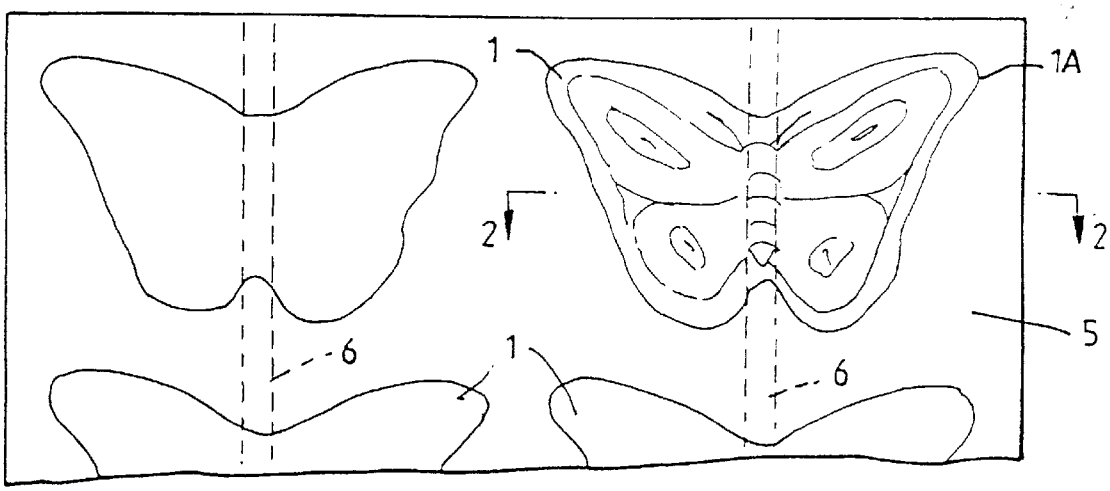
FIG. 1 is a fragmentary plan view of a sheet of decorative devices embodying the invention.
Figure 2:
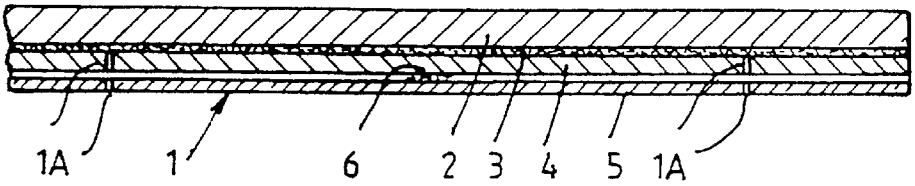
FIG. 2 is a fragmentary sectional elevation of the sheet of decorative devices taken along the line 2—2 in FIG. 1.
Figure 3:
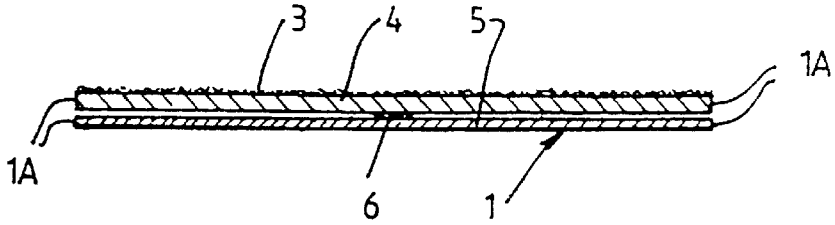
FIG. 3 is a sectional elevation of a decorative device removed from the sheet of FIGS. 1 and 2.
Figure 4:
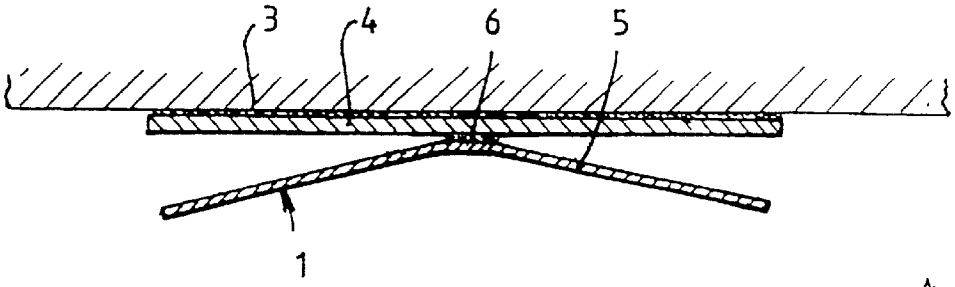
FIG. 4 is a sectional elevation of a decorative device adhesively secured to a surface.

Referring first to FIGS. 1 and 2, the sheet 1 of decorative devices 1 includes a supporting release layer 2, an adhesive layer 3 applied to the release layer and adhering to a flexible film backing member 4, a semi-rigid plastics layer 5, from which the decorative device 1 is cut along line 1A, the cut also penetrating the backing member 4, and to which printed matter further defining the decorative devices is applied, the plastics layer 5 being secured to the backing member along central narrow lines of adhesive 6 which enable the wings of the decorative devices, in the present case, butterfly replicas, to be folded away from the backing member so that the decorative device has the appearance of a resting butterfly (FIG. 4).

The release layer 2 can comprise any suitable polysiloxane or teflon coated release liner ranging from 23 $\mu$m polyethylene terephthalate to 200 $\mu$m clay or polyethylene coated Kraft paper. In the preferred embodiment, the release layer 2 comprises 62 gsm densified glassine, with one side coated with dimethyl polysiloxane.

The adhesive layer 3 applied to the release layer 2 comprises any suitable hot melt adhesive, such as a styrene-isoprene-styrene based hot melt permanent adhesive applied to the release layer and taken up by the flexible film backing member. The hot melt adhesive is preferably specifically modified to exhibit adhesion to polar (unplasticized P.V.C.) and apolar (polyolefinic) surfaces. However, any styrene-isoprene styrene, styrene butadeine styrene, styrene-ethylebutadeine-styrene, 2 ethyl hexyl acrylate, butyl acrylate, methyl acrylate hot melt system, or any of the family of block-copolymer synthetic or natural rubber based hot melt adhesives could be modified to perform this function.

The flexible film backing member 4 comprises any suitable clear synthetic film, having the capability of conforming to an uneven substrate to which the decorative device may be applied. In this specific case the film comprises 58 $\mu$m biaxially oriented polypropylene. However, the film could be pasticized P.V.C. cellulose acetate, polyethylene, polystyrene or any similar material.

The semi-rigid plastics layer 5 comprises a 125 $\mu$m unplasticized polyvinyl chloride sheet adhesively secured along narrow strips 6 corresponding to the centre line of the decorative device using a suitable hot melt adhesive such as ethylene vinyl acetate based hot melt adhesive. The adhesive strips 6 are about 5 to 10 mm in width, and in this specific example, run along the length of the body of the butterfly decoration 1.

The semi-rigid plastics layer 5 may comprise any clear or translucent rigid synthetic film having sufficient stiffness and memory to remain in a raised position when creased or folded along the central adhesive line attaching the plastics layer to the backing member. The film should be capable of being printed in an unsupported roll format by any or all of the commonly known roll printing processes such as gravure, letterpress, offset/lithography or flexography without unduly stretching or shrinking under the heat of drying or curing.

Examples of suitable synthetic films include biaxially oriented polypropylene having a thickness in the range of 12 to 80 $\mu$m, unplasticized polyvinyl chloride in the range of 75 to 200 $\mu$m, polyethylene terephthalate in the range of 23 to 60 $\mu$m, polycarbonate in the range of 25 to 75 $\mu$m, cellulose acetate in the range of 40 to 70 $\mu$m or any other suitable clear synthetic film having the properties outlined above.

The semi-rigid plastics layer is preferably adhesively secured to the backing member after printing, and at this time, the plastics layer and the backing member are preferably in the form of continuous webs. The decorative devices 1 are all cut from this web, as is the backing member 4.

In another embodiment, the semi-rigid plastics layer can be formed from a printable film, such as Mylar™ or one of the above plastics treated so as to be capable of being printed on using ink jet printing or other means of printing or colouring available to home users or from suitable service providers. In this embodiment, the decorative devices are provided in die cut shapes ready for printing or colouring by the purchaser.

It will be appreciated from the above that the decorative devices 1 embodying the invention are particularly attractive and since the parts of the plastics layer 5 which are not adhered to the backing member 4 can be folded so as to stand up from the backing member when it has been adhesively secured to a surface to be decorated, the attractiveness and appeal of the decorative device is thereby significantly enhanced.

What is claimed is:

1. A decorative device comprising:

a supporting release layer;

a flexible backing layer;

an adhesive layer on the backing layer, the adhesive layer being covered by the release layer such that the backing layer is removable from the release layer to expose the adhesive layer on the backing layer;

a decorative layer disposed on a surface of the flexible backing layer opposite to the adhesive layer;

a decorative article printed on the decorative layer, the decorative article having a pair of wings including a first wing and a second wing;

a cut extending peripherally about the decorative article printed on the decorative layer, and penetrating through the decorative layer and the flexible backing layer, but not through the supporting release layer, the cut defining a decorative element formed by a portion of the backing layer and the decorative layer within the cut and which includes said first wing and said second wing; and a strip of adhesive located substantially centrally between the first wing and the second wing for separating the first wing and the second wing, and which adheres the decorative layer to the flexible backing layer while leaving the first wing and second wing free of the backing layer and free from one another except at the substantially central strip where the decorative layer is adhered to the flexible backing layer, the strip of adhesive defining a fold line about which the first and second wings are foldable to stand out from the backing layer;

wherein the supporting release layer is removable such that the adhesive layer on the backing layer is exposed to enable the decorative element to be adhered to a surface being decorated with the first wing and second wing being foldable outwardly of the backing layer about the fold line defined by the adhesive strip so as to form wings of the decorative element which stand out from the surface being decorated.

2. A decorative device according to claim 1, including a plurality of said decorative elements, and a continuous strip of said adhesive extending between the decorative layer and the backing layer for adhering the plurality of decorative articles to the supporting release layer, wherein the cut extending peripherally about the decorative articles also penetrates the adhesive strip.

3. The decorative device according to claim 1, wherein the decorative layer is formed from a semi-rigid plastic material.

4. The decorative device according to claim 1, wherein the backing layer is formed from a clear synthetic film.

5. The decorative device of claim 1, wherein the decorative element has the appearance of a butterfly, bird, fairy or airplane.

* * * * *